US005473661A

United States Patent [19]

Buschhorn

[11] Patent Number: 5,473,661

[45] Date of Patent: Dec. 5, 1995

[54] APPARATUS FOR THE PRODUCTION OF SHORT-WAVE ELECTROMAGNETIC RADIATION

[75] Inventor: Gerd Buschhorn, München, Germany

[73] Assignee: Max-Planck-Gesellschaft zur Förderung der Wissenschaften e.V. Berlin, München, Germany

[21] Appl. No.: 162,163

[22] PCT Filed: Jun. 12, 1993

[86] PCT No.: PCT/EP92/01321

§ 371 Date: Feb. 4, 1994

§ 102(e) Date: Feb. 4, 1994

[87] PCT Pub. No.: WO92/22993

PCT Pub. Date: Dec. 23, 1992

[30] Foreign Application Priority Data

Jun. 14, 1991 [DE] Germany ..... 41 19 729.1

[51] Int. Cl.[6] ..... H01J 35/30

[52] U.S. Cl. ..... 378/119; 378/121; 378/137; 378/138

[58] Field of Search ..... 378/84, 85, 119, 378/121, 122, 124, 137, 143, 145, 138; 250/399, 503

[56] References Cited

U.S. PATENT DOCUMENTS

| | | | |
|---|---|---|---|
| 4,894,852 | 1/1990 | Das Gupta | 378/119 |
| 5,125,019 | 6/1992 | Evain et al. | 378/121 |
| 5,134,641 | 7/1992 | Friede et al. | 378/122 |

FOREIGN PATENT DOCUMENTS

| | | |
|---|---|---|
| 0276437 | 3/1988 | European Pat. Off. . |
| 1546363 | 5/1979 | United Kingdom . |

OTHER PUBLICATIONS

Rev. Sci. Instrum. 58 No. 7, Jul. 1987, pp. 1173–1176, Henins, "Variable Radius Curved Crystal Mount".

IEEE Transactions on Nuclear Science, Bd. 30, Nr. 4, 1. Aug. 1983, New York US seiten 3150–3154; Pantell et al. "Characteristics and Applications of Rediation from Channeled Particles".

Applied Physics Letters, Bd. 57, Nr. 27, 31. Dec. 1990, P.2956–2958; Genz et al: "High Intensity Electron Channeling And Perspectives For A Bright Tunable X-Ray Source".

Soviet Journal of Quantum Electronics. B.11. Nr.11.1. Nov. 1981, P.1405–1421; Kalashnikov et al, "Spontaneous and Stimulated Gamma Radiation Emitted by Relativistic Charged Channeled Particles (Review)".

Instruments and Experimental Techniques. Bd. 28, Nr.3,1. May 1985, pp. 533–535.

Kalinin, et al, "Automatic Orientation System For Single–Crystal Targets In An Electron Accelerator".

*Primary Examiner*—David P. Porta
*Assistant Examiner*—Don Wong
*Attorney, Agent, or Firm*—Nields & Lemack

[57] ABSTRACT

Apparatus for the production of short-wave electromagnetic radiaion, especially in the x-ray and gamma-ray region, by means of the interaction between accelerated charged particles, especially electrons or positrons, and a crystal lattice, with a charged-particle source for the production of a beam of energetic charged particles and with a crystal arrangement which is so arranged in the path of the charged particle radiation beam that the charged particles traverse the crystal lattice of the crystal arrangement parallel to a predetermined lattice direction ("channeling-condition"). In order to produce an electromagnetic radiation beam with predetermined convergence or divergence, there are used a correspondingly convergent or divergent charged particle radiation beam (212) as well as a crystal arrangement (214) which is so bent that the channeling condition is at least approximately fulfilled for all charged particle paths in the crystal. (FIG. 1)

16 Claims, 2 Drawing Sheets

APPARATUS FOR THE PRODUCTION OF SHORT-WAVE ELECTROMAGNETIC RADIATION

BACKGROUND OF THE INVENTION

The present invention starts from an apparatus for the production of short-wave electromagnetic radiation, especially in the x-ray and gamma-ray region, by means of the interaction between accelerated charged particles, especially electrons or positrons, and a crystal lattice, with a charged-particle source for the production of a beam of energetic charged particles and with a crystal arrangement which is so arranged in the path of the charged particle radiation beam that the charged particles traverse the crystal lattice of the crystal arrangement parallel to a predetermined lattice direction ("channeling-condition").

Energetic charged particles, which impinge upon a suitable single crystal at an angle to a crystal plane or a crystal axis which is sufficiently small, are moved in an oscillatory fashion lengthwise of the pertinent crystal direction along the crystal plane or crystal axis, respectively, (so-called channeling or canalization) and emit therewith electromagnetic radiation in the forward direction, the energy whereof lies in the x-ray or gamma-radiation region, assuming corresponding mass and energy of the incident charged particles (so-called channeling- or canalization-radiation). For example, electrons with an energy between 20 and 100 MeV produce x-rays with energies between about 20 and 200 keV in monocrystalline silicon.

In the usual apparatus for the production of canalization-radiation a charged particle radiation of the smallest possible divergence is used, which impinges upon a flat single crystal parallel to a selected crystal plane or crystal axis, respectively (Appl. Phys. Lett. 57 (27), Dec. 31, 1990, 2956–2958).

In the known apparatus of the aforementioned type, therefore, the most parallel charged particle radiation possible is used, and there arises an essentially parallel beam of electromagnetic radiation. For many applications, however, appreciably convergent or divergent beams of shortwave electromagnetic radiation are required. This creates problems, since no focusing optical elements, such as lenses, are available for short-wave electromagnetic radiation.

SUMMARY OF THE INVENTION

The present invention is based upon the task of further developing an apparatus of the aforementioned type in such a way that with it a non-parallel, and thus convergent or divergent, beam of short-wave electromagnetic radiation, especially in the x-ray and gamma-ray region, can be produced.

This task solved by means of an apparatus for the production of short-wave electromagnetic radiaion, especially in the x-ray and gamma-ray region, by means of the interaction between accelerated charged particles, especially electrons or positrons, and a crystal lattice, with a charged-particle source for the production of a beam of energetic charged particles and with a crystal arrangement which is so arranged in the path of the charged particle radiation beam that the charged particles traverse the crystal lattice of the crystal arrangement parallel to a predetermined lattice direction (lattice plane, lattice axis) ("channeling-condition"), which is characterized in that the crystal arrangment is traversed by the charged particles in at least one plane passing through the axis of the charged particle radiation beam in directions which essentially converge into a predetermined point, and in that the crystal arrangement is so arranged in an arc about the predetermined point, that the channeling condition is substantially fulfilled for all charged particle beam paths.

The apparatus according to the invention makes it possible to create a non-parallel beam of short-wave electromagnetic radiation, especially in the x-ray and gamma-ray region, with predetermined convergent- or divergent properties, since the convergence or divergence, respectively, of the short-wave electromagnetic radiation is determined by the convergence or divergence, respectively, of the charged particle radiation beam which impinges on the crystal arrangement; and the latter can easily be influenced by particle-optical means, especially electron lenses and the like, and also allows the creation of curved single-crystal arrangments without great difficulties. Further developments of the present apparatus make possible a modulation of the intensity, or of the convergence or divergence, respectively, of the electromagnetic radiation beam.

In the arrangement according to FIG. 4, one can relatively simply realize also a crystal arrangement which is bent in two planes, like a spherical cap, which can be used in combination with a rotationally symmetrically converging or diverging charged particle radiation beam.

By means of pulsed or oscillatory bending of the crystal or crystals, respectively, or of the crystal arrangement, or by means of pulsed or oscillatory rotation of the plane segments of the crystal arrangement according to FIG. 4, the intensity or convergence/divergence, respectively, of the short-wave radiation beam which is produced can be modulated in time and/or in space, and, if need be, be synchronized with external measurement conditions and/or corresponding changes in the convergence or divergence, respectively, of the charged particle radiation beam. As is shown schematically in FIG. 4, a parallel electron radiation beam 512 which is produced by an accelerator 520 can be made convergent in the plane of the drawing by an electron optical cylindrical lens 513. The electron optical lens is an electromagnetic lens, which is supplied with current by a current-supply apparatus 515 via a modulator 517. The modulator 517 allows one to control the current strength, and thereby the angle of convergence of the electron radiation beam 512.

The single crystal segments 514*a*, 514*b*, . . . are mounted on corresponding placement apparatus 519, so that the radius of curvature of the crystal arrangement 514 can be altered. As FIG. 4a shows, the placement apparatus can at any given time include a control curve 519*a*, lengthwise of which the pertinent crystal segment 514*c* is displaced and swiveled.

Instead of a cylindrically curved crystal, one can also use a spherically curved crystal, with sufficiently small crystal-size and crystal-thickness. In combination with a rotationally symmetric, convergent or divergent charged particle radiation beam, one can then fulfil the channeling-condition in a rotationally symmetric manner for a special crystal axis. Of course, corresponding considerations apply quite generally for crystals which are curved in two directions, e.g. in ellipsoidal form.

The angle of convergence or divergence, respectively, of the charged particle radiation beam will in general be greater than 0.1 mrad, e.g. greater than 0.3 mrad. As a monocrystalline crystal material, one can use e.g. silicon or diamond. As charged particles electrons are preferred, whose energies amount in general to above 1 MeV, preferably above 10 MeV. Suitable crystal directions are e.g. the [111] axis and the [100] plane in the case of silicon, and the [110] axis in the case of diamond. The thickness of the crystal arrangement can lie between about 1 μm and 1 mm. The materials and values which are given are non-limiting examples.

It has proven advantageous to cool the crystal or the crystals, respectively, e.g. by means of liquid nitrogen. In this way the line-heights of the electromagnetic radiation which is produced may be enlarged and their line-width reduced. The crystal arrangement can, for this purpose, be arranged in a suitable cryostat 224, as shown schematically in FIG. 1.

Hereinafter examples of embodiments of the invention will be explained in greater detail with reference to the drawings.

DETAILED DESCRIPTION

Figure 5:
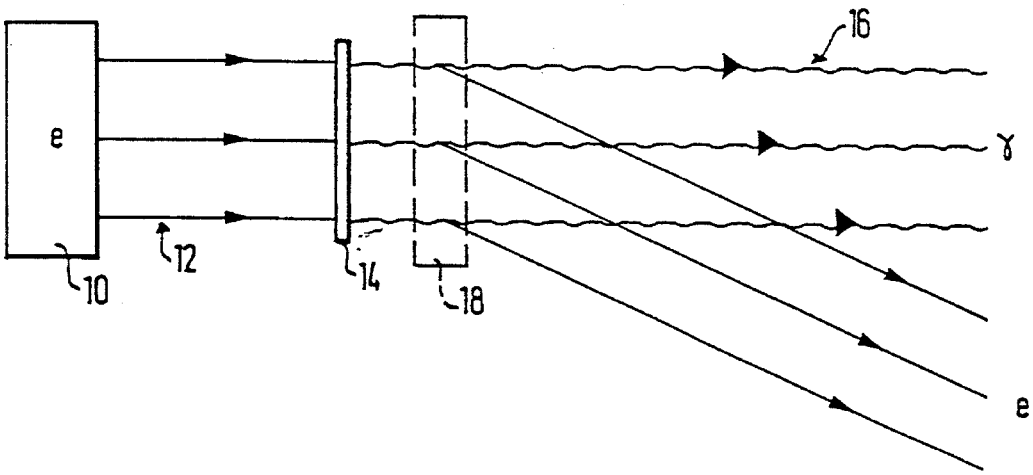
FIG. 5 shows a schematic representation of a known apparatus for the production of short-wave electromagnetic radiation by means of channeling.

FIG. 5 shows a channeling- or canalization-apparatus of customary construction in top view. A completely parallel charged-particle beam 12, produced by a charged-particle source 10 represented only schematically, e.g. an accelerator, impinges on a flat crystal 14. The charged particles, e.g. electrons, are moved along a predetermined lattice direction, thus parallel to a predetermined lattice plane or lattice axis, through the crystal and produce there, by interaction with the crystal lattice, an essentially parallel beam 26 of short-wave electromagnetic radiation, e.g. in the gamma ray region. The radiation is in general linearly polarized by the planar channeling. The charged particles which have passed through the crystal 14 are deflected away by a deflecting magnet 18 out of the beam path of the gamma radiation beam 16 and then impinge on a catcher not shown in FIG. 5. In this known apparatus the charged particle beam 12 as well as the gamma ray beam 16 are essentially parallel in a horizontal and in a vertical plane.

Figure 1:
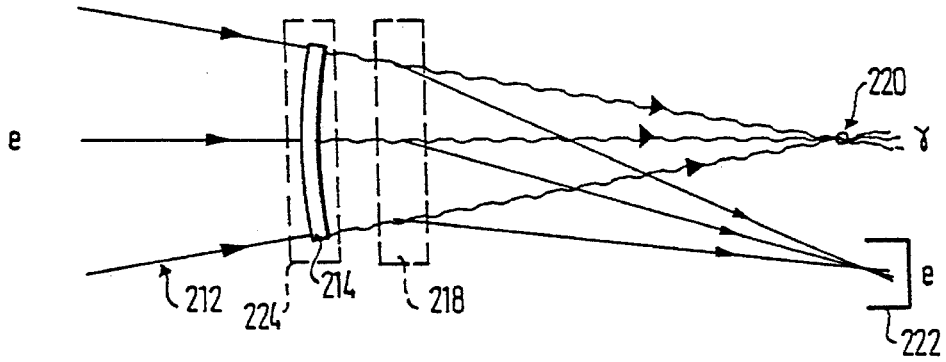
FIG. 1 shows a horizontal section of an embodiment of the apparatus according to the invention for the production of a convergent beam of short-wave electromagnetic radiation.

In the embodiment of the invention shown in FIG. 1 the charged particle source (not shown) delivers a charged particle radiation beam (in particular an electron radiation beam) 212 which is convergent in the plane of the drawing and substantially parallel in the plane perpendicular thereto. The electron radiation source can include e.g. a cylindrical electron lens. A platelet-shaped single crystal 214 is arranged in the path of the electron radiation beam 212, said crystal 214 being curved cylindrically about an axis running perpendicular to the plane of the drawing (The bending of the crystal is greatly exaggerated as shown in FIG. 1 as well as in FIGS. 3 and 4 for the sake of clarity). Thus in the plane of the drawing the directions of the electron radiation paths in the crystal converge in a predetermined point 220, and the crystal is cylindrically curved in such a manner that the channeling- or canalization-condition is substantially fulfilled for all charged particle radiation paths in the curved crystal 214. The x-ray- or gamma-radiation which is emitted from the crystal in the forward direction of the electron radiation thus likewise converges in the plane of the drawing and in planes parallel to this, so that a line-focus arises at the axis of the bending. The cylindrically symmetrically converging electron radiation beam is deflected by a deflecting magnet 218 after it has passed through the crystal 214 and impinges into a catcher 222. The bending axis of the crystal 214 thus runs through the point 220 in the plane of the drawing.

Figure 2:
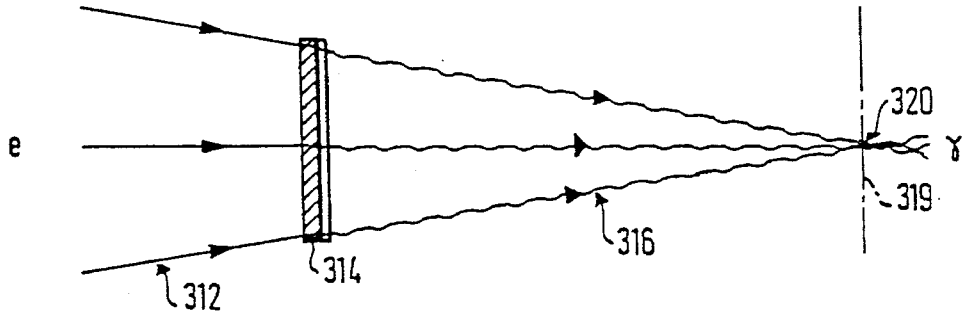
FIG. 2 shows a vertical section of a further embodiment of the invention for the production of a convergent beam of short-wave electromagnetic radiation.

In the embodiment shown in FIG. 2, which is shown as a section plane perpendicular to FIG. 1, the charged particle radiation beam 312 which is produced by the charged particle source is convergent in two mutually perpendicular planes (i.e. in the plane of the drawing and in the plane which is perpendicular to this) and produces, in combination with the crystal 314, which is cylindrically bent with respect to an axis 319 lying in the plane of the drawing, a point focus at the point 320, since the channeling condition is substantially fulfilled in all planes of the cylindrically bent crystal which pass through the axis 319 (including the plane of the drawing). The deflecting magnet and the catcher, which are usually provided in an apparatus of the present type, are not shown in FIG. 2 and the following Figures.

Figure 3:
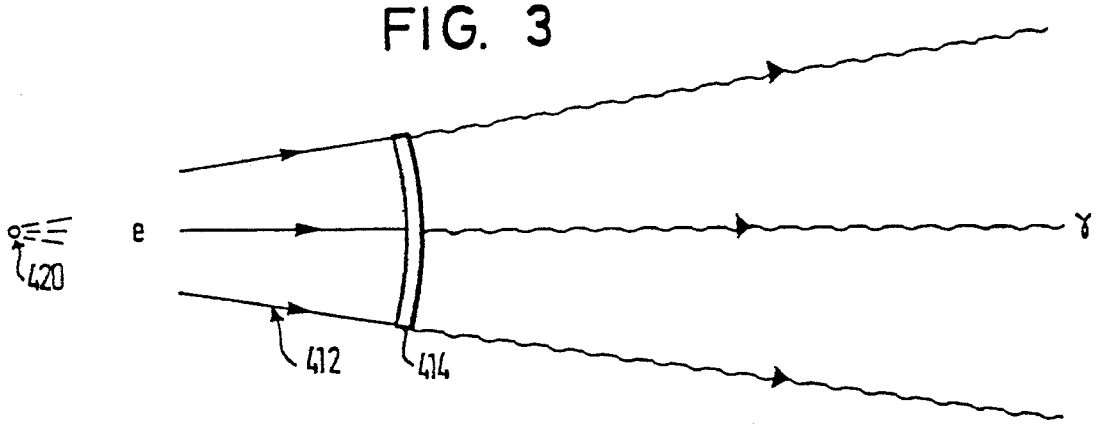
FIG. 3 shows a horizontal section of an embodiment of an apparatus according to the invention for the production of a divergent beam of short-wave electromagnetic radiation.

In the embodiment according to FIG. 3 the charged particle source (not shown) delivers a divergent charged particle radiation beam 412. The crystal 414 is correspondingly bent concavely, cylindrically or rotationally symmetrical with respect to the charged particle beam source, so that the crystal directions (crystal planes, crystal axes) along which the channeling takes place run at any given time parallel to the individual charge particle ray path. The convergence point 420 of the charged particle beam directions in the crystal and of the chosen crystal directions thus lies in FIG. 3 on the side of the crystal which faces the charged particle source and not on the side facing away from the charged particle source as in the case of the crystal in FIGS. 1 and 2.

Figure 4:
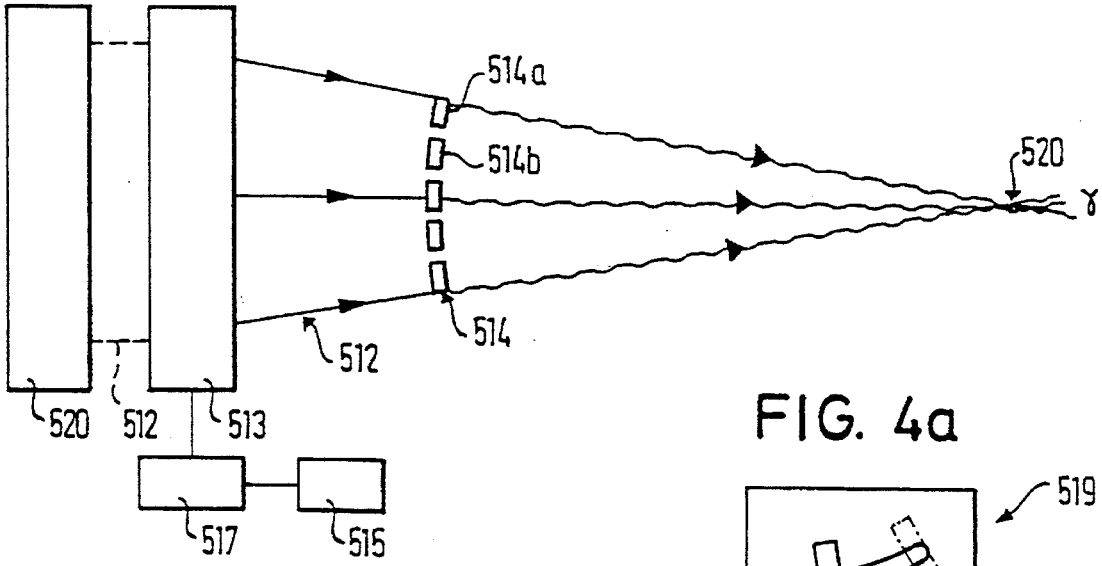
FIGS. 4 and 4*a* show a horizontal section of a further embodiment of the invention for the production of a convergent beam of short-wave electromagnetic radiation.
Figure 4A:
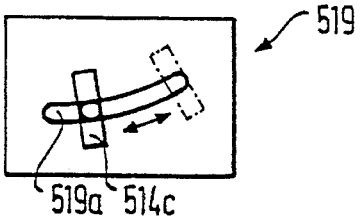

In the embodiment shown in FIG. 4 the impinging charged particle radiation beam 512 is again convergent in one or two planes or rotationally symmetrically. Here as crystal arrangement one does not use a single, correspondingly curved single crystal, but rather a plurality of curved or in some cases even plane monocrystalline-platelets or -segments 514*a*, 514*b*, . . . which are arranged in an arc or a spherical surface about the convergence point 520. If the segments 514*a*, . . . are sufficiently small, they can consist of flat monocrystalline pieces. Moreover, it is obviously simpler to bend smaller crystal platelets than a large monocrystalline plate.

I claim:

1. Apparatus for the production of short-wave electromagnetic radiaion, especially in the x-ray and gamma-ray region, by means of the interaction between accelerated charged particles, especially electrons or positrons, and a crystal lattice, with a charged-particle source for the production of a beam (212, 312, 412, 512) of energetic charged particles and with a crystal arrangement (214, 314, 414, 514) which is so arranged in the path of the charged particle radiation beam that the charged particles traverse the crystal lattice of the crystal arrangement parallel to a predetermined lattice direction (lattice plane, lattice axis) ("channeling-condition"), comprising in combination a crystal arrangment (214, 314, 414, 514) and means for directing charged particles through said crystal arrangement in at least one plane passing through the axis of the charged particle radiation beam (212, 312, 412, 512) in directions which essentially converge into a predetermined point (220, 320, 520), said crystal arrangement having a side facing away from said charged particle source and a side facing toward said charged particle source, said crystal arrangement being so arranged in an arc about the predetermined point, that the channeling condition is substantially fulfilled for all charged particle beam paths.

2. Apparatus according to claim 1, wherein said means for directing charged particles includes means for directing said charged particles in such a manner that the charged particle radiation beam which impinges on the crystal arrangement (214, 314, 514) is convergent and that the predetermined point (220, 320, 520) lies on the side of the crystal arrangement which faces away from the charged particle source.

3. Apparatus according to claim 2, wherein said means for directing charged particles includes means for directing said charged particles in such a manner that the charged particle radiation beam which impinges on the crystal arrangement (214, 314, 514) is convergent in two mutually perpendicular planes.

4. Apparatus according to claim 1, characterized in that the charged particle radiation beam which impinges on the crystal arrangement (414) is divergent and in that the predetermined point (220, 320, 520) lies on the side of the crystal arrangement which faces the charged particle source.

5. Apparatus according to any one of claims 1 through 4, characterized in that the crystal arrangement consists of one curved single crystal.

6. Apparatus according to claim 5, characterized in that the single crystal is cylindrically curved.

7. Apparatus according to any one of claims 1 through 4, characterized in that the crystal arrangement consists of several segments (514*a*, 514*b*, . . . ).

8. Apparatus according to claim 7, characterized in that the segments consist of curved monocrystalline platelets.

9. Apparatus according to claim 7, characterized in that the segments consist of flat monocrystalline platelets.

10. Apparatus according to any one of claims 1 through 4 characterized by an apparatus for changing the bending of the crystal apparatus.

11. Apparatus according to claim 7, characterized by an apparatus for swiveling the segments of the crystal arrangement.

12. Apparatus according to claim 2 characterized by an apparatus for changing the convergence of the charged particle radiation beam.

13. Apparatus according to claim 12, characterized by a synchronization of the or convergence-changing apparatus with a bend-changing apparatus or a turning apparatus, respectively.

14. Apparatus according to claim 1, characterized by an apparatus for cooling the crystal arrangement.

15. Apparatus according to claim 4, characterized by an apparatus for changing the divergence of the charged particle radiation beam.

16. Apparatus according to claim 15, characterized by a synchronization of the divergence-changing apparatus with a bend-changing apparatus or a turning apparatus, respectively.

* * * * *